US005428876A

United States Patent [19]

Boulanger et al.

[11] Patent Number: 5,428,876

[45] Date of Patent: Jul. 4, 1995

[54] LOW FLUID PRESSURE DUAL-SIDED FIBER ENTANGLEMENT METHOD, APPARATUS AND RESULTING PRODUCT

[75] Inventors: Roger Boulanger, Ste-Julie; Daniel Plourde, McMasterville; Andre Brousseau, Lavaltrie; Flavio Metta, Longueuil, all of Canada

[73] Assignee: Johnson & Johnson Inc., Quebec, Canada

[21] Appl. No.: 248,139

[22] Filed: May 24, 1994

Related U.S. Application Data

[62] Division of Ser. No. 43,423, Apr. 6, 1993, which is a division of Ser. No. 558,679, Jul. 26, 1990, Pat. No. 5,238,644.

[51] Int. Cl.[6] ..... D04H 1/70; D04H 1/72

[52] U.S. Cl. ..... 28/104; 28/105; 264/119

[58] Field of Search ..... 28/104, 105; 264/119

[56] References Cited

U.S. PATENT DOCUMENTS

| | | | |
|---|---|---|---|
| 3,214,819 | 11/1965 | Guerin | 264/119 |
| 3,917,785 | 11/1975 | Kalwaites | 264/108 |
| 5,238,644 | 8/1993 | Boulanger et al. | 28/104 |

*Primary Examiner*—James C. Cannon

[57] ABSTRACT

A low fluid pressure dual-sided fiber entangling method and apparatus for manufacturing a nonwoven fabric. A fibrous starting material whose individual fibers are capable of movement relatively to one another under the influence of applied fluid forces is subjected to co-acting opposed fluid streams while being confined between a flexible screen belt and a rigid perforated hollow drum. The fibers of the starting material are entangled under the effect of fluid forces applied in opposition, forming a reticular network which defines a pattern of blind holes, each hole extending transversely to the fabric plane and containing a protuberant fiber packing at a closed end thereof.

20 Claims, 7 Drawing Sheets

38

37

LOW FLUID PRESSURE DUAL-SIDED FIBER ENTANGLEMENT METHOD, APPARATUS AND RESULTING PRODUCT

This is a division of application Ser. No. 08/043,423, filed Apr. 6, 1993, which is a division of application Ser. No. 07/558,679, filed Jul. 26, 1990, now U.S. Pat. No. 5,238,644.

FIELD OF THE INVENTION

The invention relates to the general field of fibrous materials and, more particularly, to a novel method for entangling loosely associated fibers to form a unitary reticular network by using fluid streams applied in opposition to the fibers. The invention also extends to an apparatus for carrying out the method and to the resulting product.

BACKGROUND OF THE INVENTION

Nonwoven fabrics are well-suited for applications which require a low cost fibrous web. Examples are disposable articles such as polishing or washing cloths, cast paddings and facing layers for fibrous mat products.

Nonwoven fabrics are normally produced from a web of loosely associated fibers that are subjected to a fiber rearranging method to entangle and mechanically interlock the fibers into a unitary reticular network. The fiber rearrangement is achieved under the effect of fluid forces applied to the fibers through a fluid permeable web confining and supporting structure comprising a rigid apertured member with a predetermined pattern of fluid passages, and a flexible foraminous sheet disposed in a face-to-face relationship to the apertured member. In one form of construction, the rigid apertured member is a rotating hollow drum and the flexible foraminous sheet is an endless screen belt in overlapping relationship with the hollow drum and advancing therewith. The web of loosely associated fibers which forms the starting material of the nonwoven-fabric production method is confined between the drum and the screen belt and is advanced through a fluid stream creating the entangling forces on the fibers.

The so-called "Rosebud" nonwoven fabric production method requires that the fluid stream be located outside the hollow drum, the fluid particles impinging on the fibers through the screen belt. In operation, the fibers are drawn by the fluid mass flowing out of the apertured hollow drum, into the fluid passages thereof, and they are mechanically interlocked and entangled in protuberant packings which are interconnected by flat fiber bundles extending over the land areas of the drum. The resulting nonwoven fabric has a three-dimensional structure presenting a knobby side containing the apexes of the fiber packings, and a flat and smoother side containing the base portions of the fiber packings and the interconnecting bundles.

In a variant of the Rosebud method, known as the "Keybak" method, the direction of the fluid stream is reversed, whereby the fluid particles reach the fibers by passing through the fluid passages on the drum. In contrast to the Rosebud method, the fibers are packed together on the land areas of the drum forming network with clear holes arranged into a pattern corresponding to the pattern of fluid passages on the hollow drum.

For a wide range of applications, nonwoven fabrics having superior resistance characteristics are required.

Basically, the resistance or durability of a nonwoven fibrous web depends on the degree of fiber entanglement achieved during the fiber rearranging process. When the fibers are tightly interlocked, they form a dense and tenacious network which is highly resistant to forces tending to destroy the web integrity, such as tear forces for example. In contrast, a web constituted by loosely associated fibers is substantially less resistant because, at the fiber level, the network of the web lacks cohesion.

In conventional nonwoven fabric production methods, a certain increase in the degree of fiber entanglement may be achieved at the fiber rearranging stage by increasing the fluid supply pressure of the stream in order to augment the intensity of the fluid forces acting on the fibers. However, there are disadvantages and inherent limits in increasing the fluid supply pressure which considerably offset any advantage that may be gained in terms of higher fiber entanglement. Traditional production methods already require fairly high fluid supply pressures and a further pressure increase creates considerable strain on the equipment which translates into an increase of the fabric manufacturing cost. In addition, regardless of cost considerations, the fluid supply pressure cannot be indefinitely increased as beyond a certain point, a destructive condition known as "flooding" occurs which is defined as a loss of web identity resulting from the application of fluid forces to the fiber which are too intense.

It is also known from the prior art to apply a binder substance to the fibers of the fabric subsequently to the fiber rearranging step, in order to increase the fabric resistance. The binder substance, when cured, establishes a bond between adjacent fibers and prevents them to move one relative to the other. Accordingly, the tenacity of the fabric will increase because of the reduction in the inter-fiber displacement when destructive forces act on the fabric.

Although a binder can effectively increase the resistance of a nonwoven fabric, for cost considerations, it cannot be considered as an ideal solution. Fundamentally, the objective of any nonwoven fabric production method is to turn out the least expensive product, therefore, it is desirable to eliminate or at least reduce as much as possible the binder application.

OBJECTS AND STATEMENT OF THE INVENTION

An object of the invention is a novel three-dimensional nonwoven fabric having superior resistance characteristics and possessing two textured sides, high bulk, softness, better absorbency and aesthetics.

Another object of the invention is a novel low pressure fluid formation method and apparatus for producing the aforementioned fabric.

Yet, another object of the invention is a method and an apparatus for fluid formation of nonwoven fabrics allowing a higher level of control of the fabric structure.

In one aspect, the invention provides a method for fluid formation of a unitary nonwoven fabric, comprising the steps of:

- providing a fibrous starting material whose individual fibers are capable of movement relatively to one another under the influence of applied fluid forces; and
- subjecting the fibrous starting material to opposed coacting fluid streams while supporting the material between an apertured member having a predetermined pattern of fluid passages therethrough and a foraminous fluid permeable member, whereby under the influence of fluid forces applied in opposition, the individual fibers of the starting material are entangled forming a reticular network which defines a pattern of holes corresponding to the predetermined pattern of fluid passages on the apertured member.

For the purpose of this specification, the scope of the expression "opposed coacting fluid streams" is not intended to be restricted to an arrangement where the fluid streams are colinear, but should be construed to encompass any form of construction where a given fiber of the starting material is subjected simultaneously to the influence of fluid streams having generally opposite directions. Having regard to the foregoing, an embodiment with slightly offset or staggered fluid streams is considered to meet this definition at the condition that the majority of the fibers in the web of starting material are long enough and are oriented in such a way as to span the offset between the streams. Hence, a given fiber under fluid treatment will be affected simultaneously by the streams, albeit the streams will be acting on different portions of the fiber. The degree of offset between the streams which will determine whether they are coacting or not is primarily a function of fiber length and fiber orientation. In a web formed of short fibers, only a small offset will be allowed, however in a web of longer fibers, it is possible to further space the streams and still retain the benefit of a simultaneous dual stream action on the fibers.

In addition, the respective propagation paths of the streams do not necessarily have to be parallel or colinear in order to be characterized by "opposite". This word is to be interpreted in a broad sense, as it is intended to encompass embodiments where the streams are at a certain angular relationship which is such that the streams give rise to fluid forces whose principal components are applied to the web along truly opposite directions.

In a preferred embodiment, the apertured member is a rotating rigid hollow drum while the foraminous fluid permeable member is an endless screen belt for holding the fibrous starting material against the drum. The opposed fluid streams are created by providing inside and outside of the hollow drum, manifolds with respective jets disposed in a face-to-face relationship. The fluid mass coming from the manifold positioned outside the hollow drum is diffused through the screen belt and impacts on the fibers drawing them in the fluid passages of the drum as this fluid mass flows therethrough. The opposite fluid stream produced by the inside manifold passes through the fluid passages and has a tendency to eject the fibers out of the fluid passages and to pack them over the land areas of the hollow drum. Surprisingly, it has been found that the fluid forces applied to the fibers in opposition have a synergistic effect, rearranging the fibers into a reticular network having a substantially higher degree of entanglement and cohesion comparatively to what can be achieved with a single-sided fluid formation method, be it the Rosebud or the Keybak method.

The method according to the invention is highly advantageous because it uses a relatively low fluid supply pressure, yet it can deliver a higher fiber entanglement comparatively to single sided fluid formation methods, to produce fabrics which require less binder to achieve predetermined resistance characteristics. In addition, the method can also increase the fabric performance in bulk, softness, absorbency and texture.

The dual-sided fluid entangling method can achieve different fabric structures by selectively varying the intensity of the fluid forces acting in opposition on the fibers. In one extreme condition when only the manifold located inside the hollow drum operates, the nonwoven fabric has a network defining a pattern of clear holes corresponding to the pattern of fluid passages on the hollow drum. This fabric structure is identical to what can be obtained with the Keybak method.

By activating the outside manifold to impinge a fluid stream on the fibrous starting material through the screen belt, the structure of the nonwoven fabric is altered. The clear holes will start closing at the extremity facing the screen belt and a protuberant fiber packing will form at the closed end of each hole. This three-dimensional fabric structure is novel and constitutes another aspect of the present invention. Conventional three-dimensional fabrics have only one textured side, the other one being flat, while the aforementioned network structure provides a fabric with two textured surfaces having a very distinct appearance and feel. On one side of the fabric are disposed the openings of the blind holes creating a pattern of recesses, the opposite side being knobby as a result of the protuberant fiber packings closing the holes.

Further augmenting the velocity of the stream from the outside manifold with respect to the velocity of the stream from the inside manifold will result in a further growth of the fiber packings at the expense of an erosion of the network defining the holes which will become shallower, bringing the fiber packings closer to the drum surface.

Shutting down the inside manifold is the other extreme condition. The fiber packings will grow larger and will penetrate into the drum openings. The holes will disappear creating flat fiber bundles interconnecting the protuberant fiber packings and extending over the land areas of the drum. This fiber structure is equivalent to what is achieved with the Rosebud method.

In summary, each fluid stream imparts a distinct pattern to the web of starting material and when the opposite streams are simultaneously applied to the web, the fibers are tightly entangled into a fabric network where the two patterns coexist. If it is desired that one of the patterns predominates the other, this can be achieved simply by increasing the intensity of the fluid stream creating this pattern relatively to the intensity of the other stream.

The ability of the method to control the fabric structure constitutes another aspect of the invention. In broad terms the method can be expressed as the combination of the following steps:

providing a fibrous starting material whose individual fibers are capable of movement relatively to one another under the influence of applied fluid forces;

subjecting the fibrous starting material to coacting opposed fluid streams while confining the material between spaced apart foraminous members forming a fluid permeable supporting structure, whereby under the influence of fluid forces applied in opposition the individual fibers of the material are entangled forming a reticular network; and controlling the intensity of the fluid forces to control the fiber distribution profile of the network in a transverse direction to the plane of the nonwoven fabric.

In a further aspect, the invention provides an apparatus for producing a unitary nonwoven fabric from a fibrous starting material whose individual fibers are capable of movement under the influence of applied fluid forces, the apparatus comprising a fiber rearranging station which includes:

a) an apertured member having fluid passages therethrough;

b) a foraminous member spaced apart from the apertured member to define therewith a fluid permeable supporting structure for the fibrous starting material; and c) means to generate opposed and coacting fluid streams producing respective fluid forces which are applied in opposition to the starting material through the fluid permeable supporting structure, causing a dual-sided fiber entangling of the starting material to form the nonwoven fabric.

Advantageously, the apparatus comprises means to control the intensity of the fluid forces in order to control the nonwoven fabric structure. In a preferred embodiment, the pressure of the fluid supply to the Jets producing the streams can be selectively varied to produce the desired fabric network pattern.

The file of this application contains at least one drawing executed in color. Copies of this patent with color drawings will be provided by the Patent and Trademark office upon request and payment of the necessary fee.

DESCRIPTION OF A PREFERRED EMBODIMENT

Figure 1:
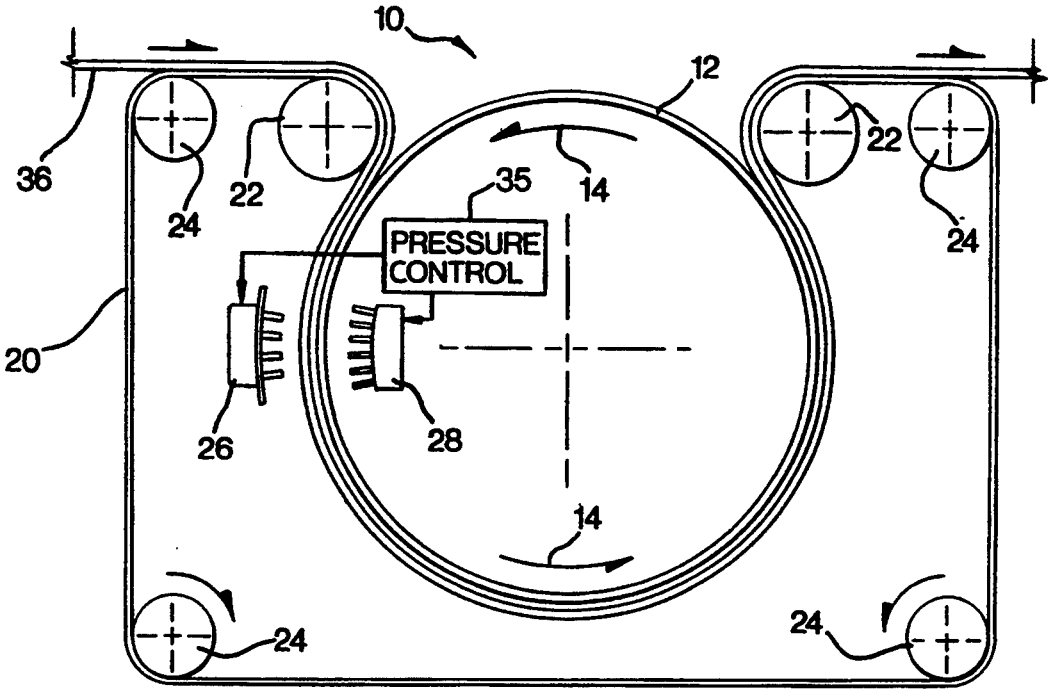
FIG. 1 is a schematical view of the fiber rearranging station of an apparatus for producing a nonwoven fabric in accordance with the invention.

FIG. 1 is a schematical side view of the fiber rearranging station of an apparatus used for the manufacture of a nonwoven fabric by applying fluid forces to a web of starting material in which the individual fibers are loosely associated and are free to move one relatively to the other. The fiber rearranging station, identified comprehensively by the reference numeral 10, comprises a hollow metallic drum 12 mounted for rotation about its longitudinal axis into a suitable cradle (not shown). A drive mechanism (not shown) is provided to rotate the drum 12 in the counterclockwise direction, as shown by the arrows 14 at a controlled speed. The drive mechanism is of a well-known construction and does not form part of this invention.

The structure of the hollow drum 12 will be described with more detail by referring to FIGS. 2 and 3. The shell of the drum 12 is provided on its entire surface with perforations 16 arranged into a predetermined pattern and separated from one another by land areas 18 corresponding to the closed or impermeable zones of the drum 12. The pattern of the openings 16 is an important factor which determines, in conjunction with other factors, the network structure of the nonwoven fabric. In the art of manufacturing nonwoven fabrics, the effect of the perforation scheme on the nonwoven fabric structure is well understood by those skilled in the art and it is not deemed necessary here to discuss this matter.

Referring back to FIG. 1, the fiber rearranging station 10 also comprises an endless screen belt 20 which is mounted in a partially overlapping relationship to the drum 12 by means of guide rollers 22. Support rollers 24 are positioned at the corners of an imaginary rectangle and act, in conjunction with guide rollers 22, to tension and establish a path for the screen belt 20. One or more of the rollers 22 or 24 are drive rollers for advancing the belt 20 in unison with the drum 12, in other words to prevent a relative translatory motion therebetween.

The structure of the screen belt 20 is another factor influencing the network structure of the nonwoven fabric, as it is known to those skilled in the art. Therefore, the screen belt must be selected carefully in accordance with all the other operating conditions of the machine, such as the type of drum which is being used, the type of fibers to be processed and the desired fabric network structure and surface finish, among others, to optimize the performance of the machine.

A pair of manifolds 26 and 28 are mounted on either side of the structure formed by the screen belt 20 and the hollow perforated drum 12 to create fluid streams for rearranging loosely associated fibers confined between the drum 12 and the screen belt 20 into a unitary, thin reticular network. The manifold 26 is located outside the hollow drum 12 and includes a metallic box 30 with a concave wall 32 which faces the drum/screen belt and has a curvature corresponding to the curvature of the drum shell. On the concave wall 32 are mounted a series of water jets or nozzles 34 in fluid communication with the interior of the box 30 so as to create a plurality of fluid streams impinging on the screen belt 20. The concave shape of the wall 32 permits the orientation of each jet 34 into a radial direction relative to the drum/screen belt and also to position the extremity of each nozzle at exactly the same distance from the screen belt 20. This feature is best illustrated in FIGS. 1 and 2.

The nozzles 34 are grouped into four parallel rows, each row extending along the longitudinal axis of the drum 12. The nozzles produce fluid streams under the form of flat cones lying in an imaginary plane which contains the drum longitudinal axis, the nozzles into the same row being spaced from one another by a distance so that a certain overlap occurs between streams from adjacent nozzles immediately in front of the screen belt 20. The distance between successive nozzle rows is relatively small so that, for all practical purposes, the individual fluid streams produced by the nozzles 34 are united into a common fluid front acting on a given area of the fibrous web in the drum/screen belt facing the manifold 26.

The structure of the manifold 28 is essentially the same as in the case of the manifold 26, the only exception being that the front wall of the manifold is convex rather than concave for following the internal curvature of the hollow drum 12, and also six rows of nozzles are provided instead of four.

The individual fluid streams from one manifold do not necessarily have to be colinear with the individual fluid streams from the other manifold. A certain degree of offset or stagger, either in the machine direction, the cross-machine direction or an intermediate direction, is allowed upon the condition that the majority of the fibers forming the starting material are long enough and oriented in such a way as to span the offset distance between two opposite fluid streams, whereby the fibers will be subjected to the influence of fluid forces applied in opposition, albeit acting on different portions of a given fiber. The maximum permissible amount of offset depends upon the average fiber length. The orientation of the offset should normally be consistant with the fiber orientation in the starting material.

Figure 2:
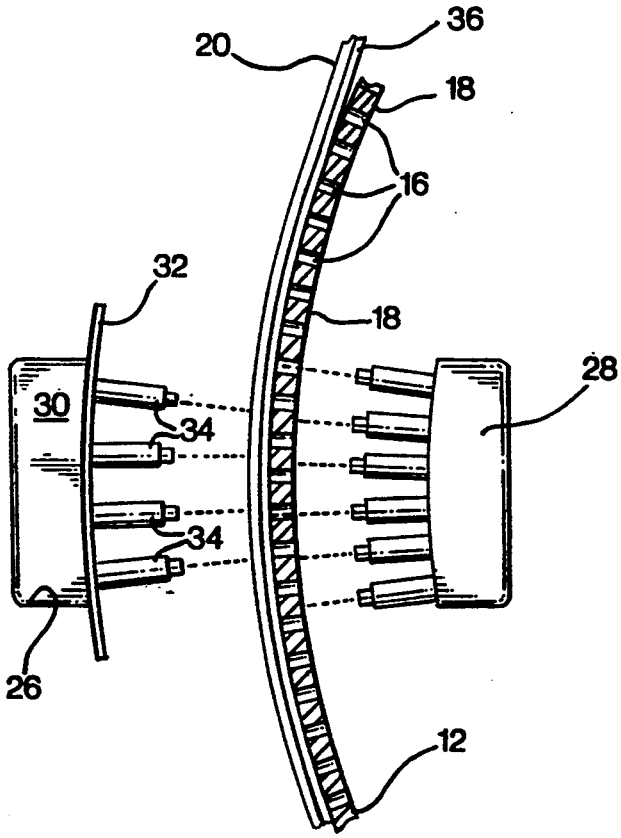
FIG. 2 is an enlarged fragmentary side view of the fiber rearranging station, illustrating the manifolds creating the opposed fluid streams.
Figure 3:
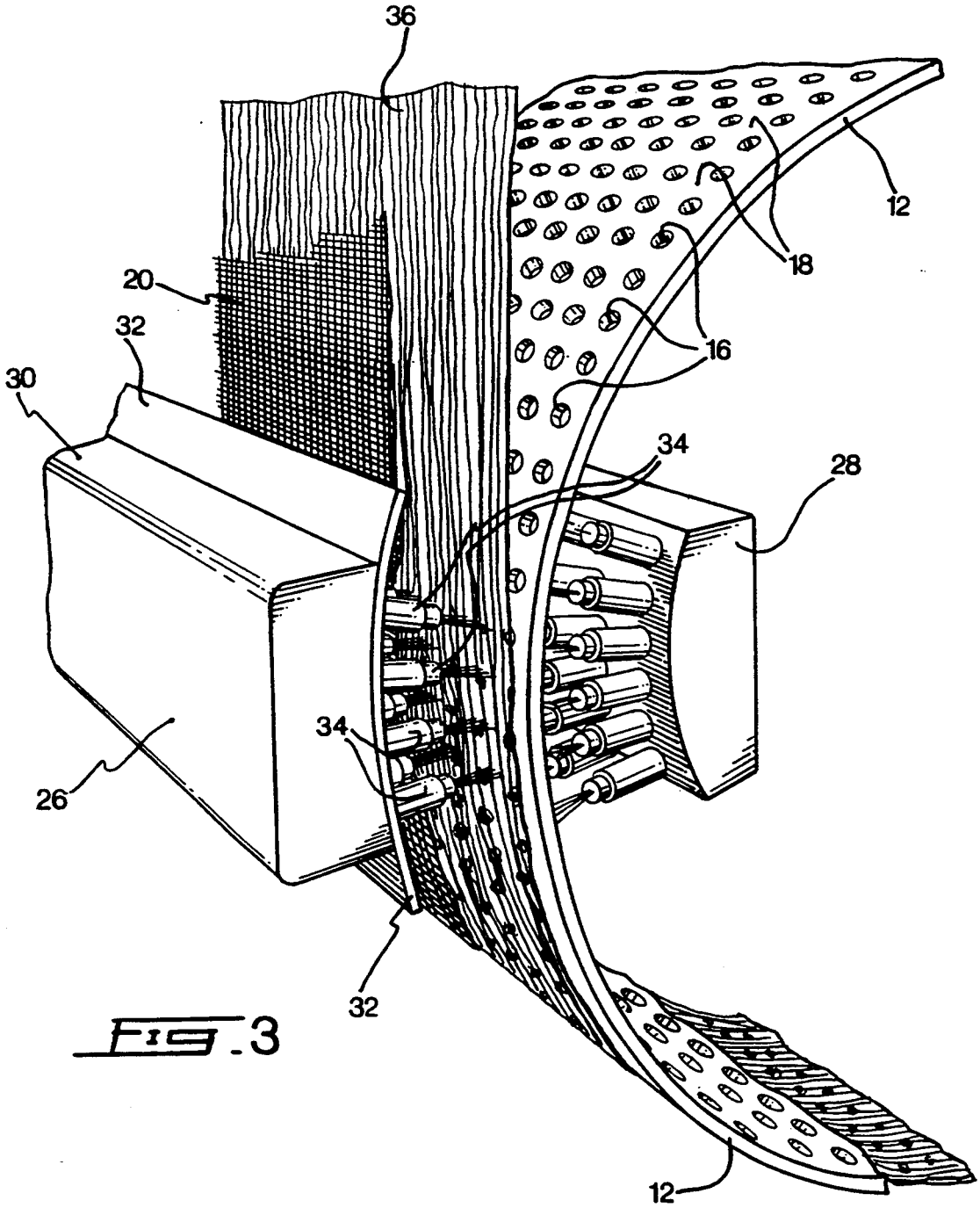
FIG. 3 is a perspective and a further enlarged view of the fiber rearranging station illustrating in addition to FIG. 2, the structure of the perforated hollow drum and of the screen belt for holding and advancing fibrous starting material between the fluid streams.

The embodiment shown in FIG. 2 is an exemplary hybrid form of construction where the two lower nozzle rows of the manifold 26 are perfectly in line with the two lower nozzle rows of the manifold 28, while the two upper nozzle rows of manifold 26 are slightly offset with relation to their companion nozzle rows of manifold 28. The important point is that the arrangement does not adversely affect the operation of the apparatus, achieving a fully satisfactory dual-sided fiber entangling action. The difference in operation between embodiments using colinear streams and slightly offset streams resides essentially in the speed of fiber entangling. When the streams are colinear, the entangling of the fibers is almost immediate because the fibers are subjected to intense and localized forces. In contrast, with offset streams, the entangling action is achieved progressively as the fibers move through successive streams.

The individual fluid streams produced by the nozzle banks of manifolds 26 and 28 do not have to be necessarily oriented in the plane containing the drum axis. It may very well be envisaged to rotate or tilt the nozzles to incline the streams with reference to the drum axis. In such a construction, the overlap between adjacent streams will be lost because the streams will lie in respective planes which are parallel to one another and they extend obliquely to the drum axis. Varying the orientation of the fluid streams is an adjustment that can be performed to obtain a uniform web treatment, preventing the formation of fuzziness zones in the final product.

It is also possible to orient the nozzles of the manifolds 26 and 28 at a certain angular relationship so that the fluid streams are not perfectly colinear nor parallel. This variant can also function well at the condition that the fluid streams give rise to fluid forces which have major components applied in opposition along colinear or parallel directions to the web.

The number of nozzles per manifold is a function of the amount of energy per unit of time or power, that must be supplied by the fluid streams to rearrange the fibers of the web into the desired network structure. The type of fibers used, the speed of the web through the fluid streams, among other factors, determine the power requirement of the apparatus.

Although not shown in the drawings, it is to be understood that the manifolds 26 and 28 are connected to respective sources of pressurized fluid, preferably water, for producing the fluid streams. Fluid supply pressure control devices 35, of a type known in the art, are also provided so that the fluid supply pressure in each manifold can be conveniently controlled.

The operation of the fiber rearranging station 10 is as follows. A web 36 of starting material, containing loosely associated fibers, thus capable of movement one relative to the other, is supplied in a continuous sheet form from a supply station (not shown) that will also card the fibers in the machine direction and is deposited over the horizontally extending forward run of the screen belt 20 preceding the section of the screen belt which loops the hollow drum 12. The web 36 is pulled between the hollow drum 12 and the screen belt 20, which form in combination a fluid permeable web confining and supporting structure guiding and advancing the web 36 through the opposed water streams from the manifolds 26 and 28, applying fluid forces to the web fibers to entangle them and form a unitary reticular network.

When the web 36 passes through the fluid treatment zone, the fibers in the area of the web 36 over which the fluid fronts generated by the manifolds 26 and 28 meet are subjected to fluid forces applied through respective sides of the fluid permeable web confining and supporting structure. Under the effect of coacting fluid forces applied in opposition, the fibers will migrate toward preferential positions, overcoming inter-fiber friction, fiber to screen belt friction and fiber to drum friction. The fibers leaving the treatment zone are reoriented into a reticular network whose basic configuration is dependent upon the relative intensities of the fluid forces and upon the drum/screen belt combination, and which has a considerably higher degree of fiber entanglement by comparison to what can be achieved with a conventional method using only one fluid stream, either on the inside or on the outside of the drum.

The fundamental aspect of this invention resides in applying to the web opposite and coacting fluid streams. Surprisingly, these opposite fluid streams have a synergistic effect, rearranging the fibers into a predetermined network with a higher degree of entanglement by comparison to single sided fluid formation methods. Another significant advantage which results from the use of opposed fluid streams to rearrange the fibers resides in the lower fluid supply pressure necessary to operate the apparatus which contributes to reduce the manufacturing cost of the final product.

Results of tests conducted with an apparatus according to the invention are summarized in the following table. Different fabric samples have been produced by varying the manifold fluid supply pressures. For each sample, the following data is reported:

1) Pressure in manifolds 26 and 28 in pounds per square inch gage (psig);
2) weight (W) in grams per meter squared ($g/m^2$):
3) tensile strength (TS) in Newton per 6 ply (N/6 ply), measured in the machine direction (MD) and in the cross-machine direction (CD);

4) the percentage of elongation (% ELONG) measured in the machine direction and in the cross-machine direction;
5) the tenacity (TEN) measured in the machine direction and in the cross-machine direction in pounds per ply (lb/ply) over 100 grains per yard squared (grains $yd^2$); and
6) a general measure of the sample tenacity (G. TEN), reflecting the level of entanglement achieved, which is defined as the square root of the product between the machine direction tenacity and the cross-machine direction tenacity values.

All samples are produced with a screen belt HC-7-800 commercialized by TETCO INC., having a mesh opening of 800 microns. The hollow drum used has 144 openings per square inch corresponding to a 38% open area. The pattern of holes on the drum is such as shown in FIG. 2, where the holes are grouped into rows and columns intersecting at right angles. The manifold 26 has four rows of nozzles, each nozzle having a 10–15 size, oriented at 0°, i.e. the resulting fluid stream is horizontal. The manifold 28 has six rows of nozzles, each nozzle having a size 15–12, tilted at 45° relatively to the drum axis.

values are achieved as a result of relatively high fluid supply pressures in each manifold.

Figure 4:
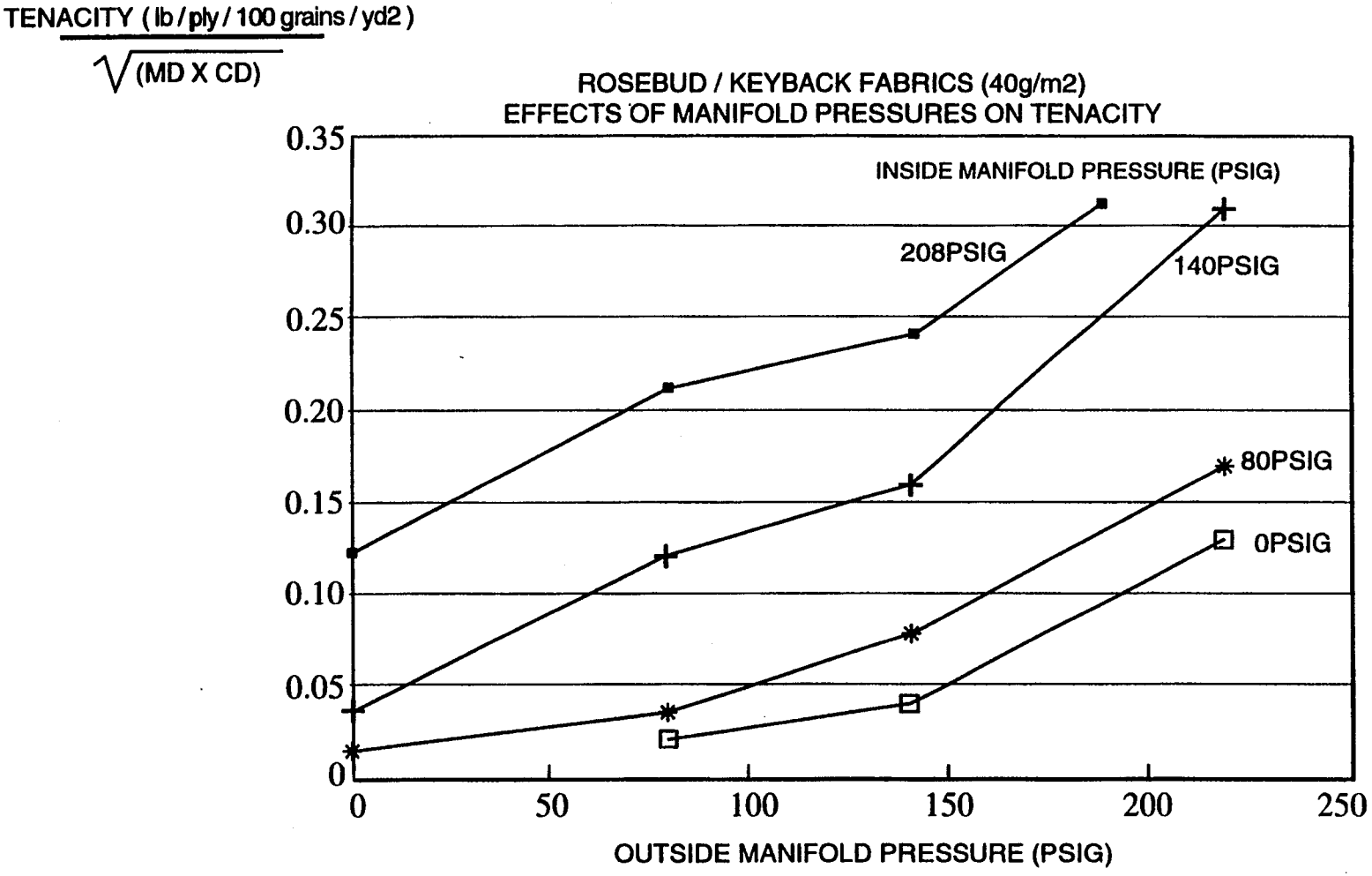
FIG. 4 is a graph showing the effect of manifold pressure on the tenacity of the nonwoven fabric.

The above table and the graph in FIG. 4, also illustrate another advantage of the method according to the invention residing in the low fluid supply pressure necessary to entangle the fibers. In all cases, fluid supply pressures not exceeding 220 psig have been used, which is considerably less than conventional processes that may require pressures above 1000 psig.

Figure 5:
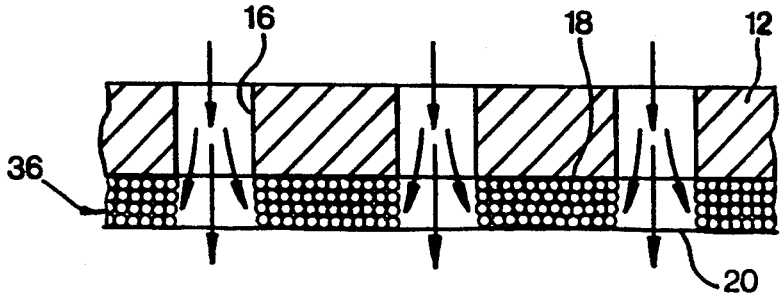
FIGS. 5, 6, 7, 8 and 9 are schematical diagrams illustrating how the variation of the intensity of one fluid stream relative to the other fluid steam affects the fiber rearranging process.

The fiber rearranging process which occurs under the operating conditions corresponding to sample 1, is schematically illustrated in FIG. 5. Only the manifold 28 is operative, projecting fluid streams against the internal surface of the hollow drum 12. The fluid mass flows through the openings 16, packing the individual fibers of the web 36 on the land areas 18 of the drum. The resulting fabric network structure is identical to what is achieved with the Keybak method, i.e. having a pattern of clear holes in register with the drum openings 16.

Figure 6:
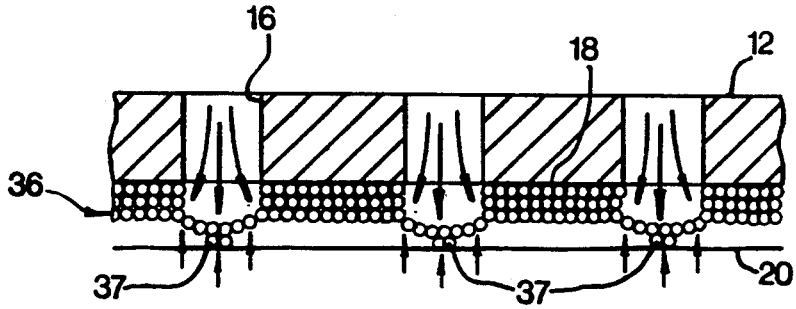

The fiber rearranging process corresponding to sample 2 is shown in FIG. 6. Both manifolds operate, the inside manifold being supplied with fluid under a higher pressure than the outside manifold. The fluid force

| SAMPLE NUMBER | PRESSURE MANIFOLD 28 | PRESSURE MANIFOLD 26 | W | TS MD | TS CD | % ELONG MD | % ELONG CD | TEN MD | TEN CD | G. TEN |
|---|---|---|---|---|---|---|---|---|---|---|
| 1 | 140 | 0 | 39.1 | 16.7 | 1.5 | 35 | 208 | 0.12 | 0.011 | 0.036 |
| 2 | 140 | 80 | 42.0 | 71.5 | 4.4 | 33 | 201 | 0.49 | 0.030 | 0.121 |
| 3 | 140 | 140 | 42.0 | 71.1 | 7.3 | 35 | 203 | 0.49 | 0.050 | 0.157 |
| 4 | 140 | 220 | 43.8 | 166.7 | 13.4 | 26 | 212 | 1.10 | 0.088 | 0.311 |
| 5 | 0 | 140 | 42.0 | 44.5 | 0.7 | 35 | 72 | 0.31 | 0.005 | 0.039 |

CONSTANTS
belt press (60 psig)
speed of 30 feet per minute (f/m)
30 centimeters Line The general tenacity values of samples 1, 4 and 5 are particularly significant, illustrating the improvement in entanglement that can be achieved with the present method. Sample 1 has been produced with only one fluid stream at 140 psig generated by the manifold 28 which is located within the hollow drum, the outside manifold 26 being rendered inoperative by shutting down its fluid supply. The method is therefore equivalent to the Keybak method. The general tenacity value that has been achieved is 0.036.

Sample 5 has been produced under reversed operating conditions, i.e., manifold 26 is functional at 140 psig while manifold 28 is inoperative. The method is equivalent to the Rosebud method. The general tenacity value is 0.039, virtually the same as in the case with sample 1.

Sample 4 has been produced with both manifolds operating at 140 psig, the same fluid supply pressure used with samples 1 and 5. The general tenacity value achieved is 0.157, an improvement of over 400% by comparison to samples 1 and 5 produced with prior art single sided fluid formation methods.

The graph in FIG. 4 illustrates the effect of manifold pressure on the general fabric tenacity. The fabric used for the test has a weight of approximately 40 $g/m^2$.

The fluid supply pressure of manifold 26 appears on the X axis. The general fabric tenacity appears on the Y axis. Various curves are plotted for given fluid supply pressures of the manifold 28. The graph shows that the tenacity of the fabric increases as the fluid supply pressure in either manifold increases. The higher tenacity acting on the web 36 through the screen belt 20 starts closing the holes produced by the fluid mass flowing out of the drum 12. Packings of fibers, identified by the reference numeral 37, starts forming at the closed ends of the fabric holes.

Figure 7:
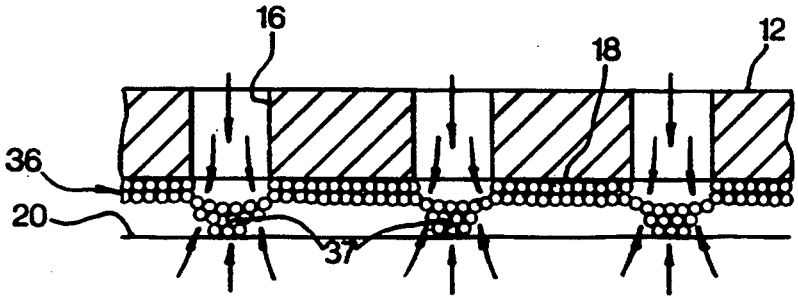

FIG. 7 illustrates the fiber rearranging process corresponding to sample 3. The fluid forces acting on either side of the web 36 have the same intensity as the fluid supply pressure to each manifold is the same. Under these operating conditions, a certain equilibrium between the effect of each stream on the web is noted. By comparison to the previous Figure, the packings 37 are now clearly visible as a result of a fiber migration from the network defining the holes to the packings 37. Accordingly, the holes in the fabric are shallower which has the effect of bringing the packings 37 closer to the drum outside surface.

Figure 8:
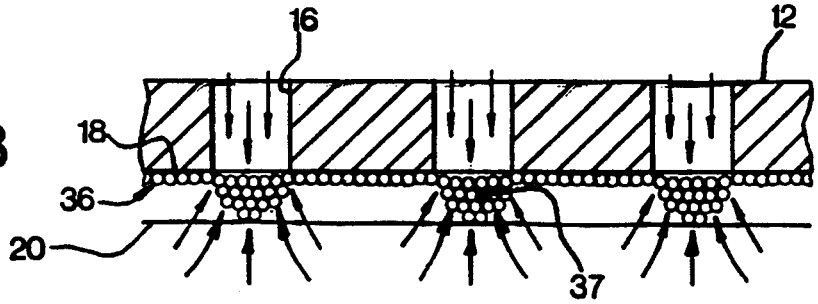

FIG. 8, corresponding to the fiber rearranging process of sample 4, illustrates what occurs when the intensity of the outside stream is higher than the intensity of the stream produced inside the drum 12. The packings 37 have grown larger at the expense of the fabric network which defines the holes, and are closer to the drum outside surface.

Figure 9:
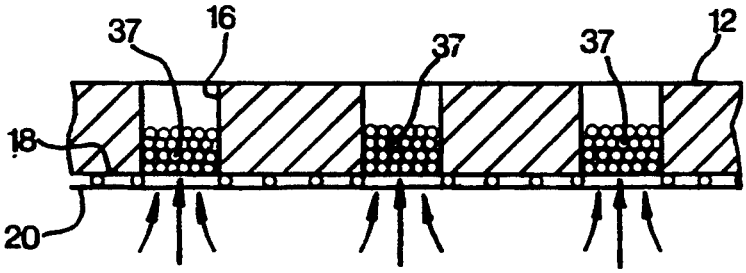

FIG. 9, corresponding to the fiber rearranging proces of sample 5, shows what happens when the internal manifold is shut down. The resulting fabric structure exhibits large fiber packings sitting in the openings 16 of the drum 12. The original structure of holes has disappeared. The only fibers remaining on the land areas 18 of the drum 12 serve to interconnect the fiber packings 37. This fabric network structure corresponds to what is achieved with the Rosebud method.

The ability of the method for manufacturing a nonwoven fabric to control the fabric network structure by adjusting the relative intensities of the fiber entangling fluid forces constitutes another important advantage of the invention. With this method, it becomes very easy to fine tune the fabric structure for specific applications simply by selectively varying the manifold fluid supply pressure. The fluid streams impart respective and distinct patterns to the fabric, which coexist in the final product. More specifically, the fluid stream from the manifold 28 creates the holes in the fabric. The fluid stream from the manifold 26 closes the holes, producing a protuberant fiber packing or knob at the end of each hole. One pattern can be made predominant simply by increasing the velocity of the fluid stream providing this pattern relatively to the velocity of the other fluid stream.

Figure 10:
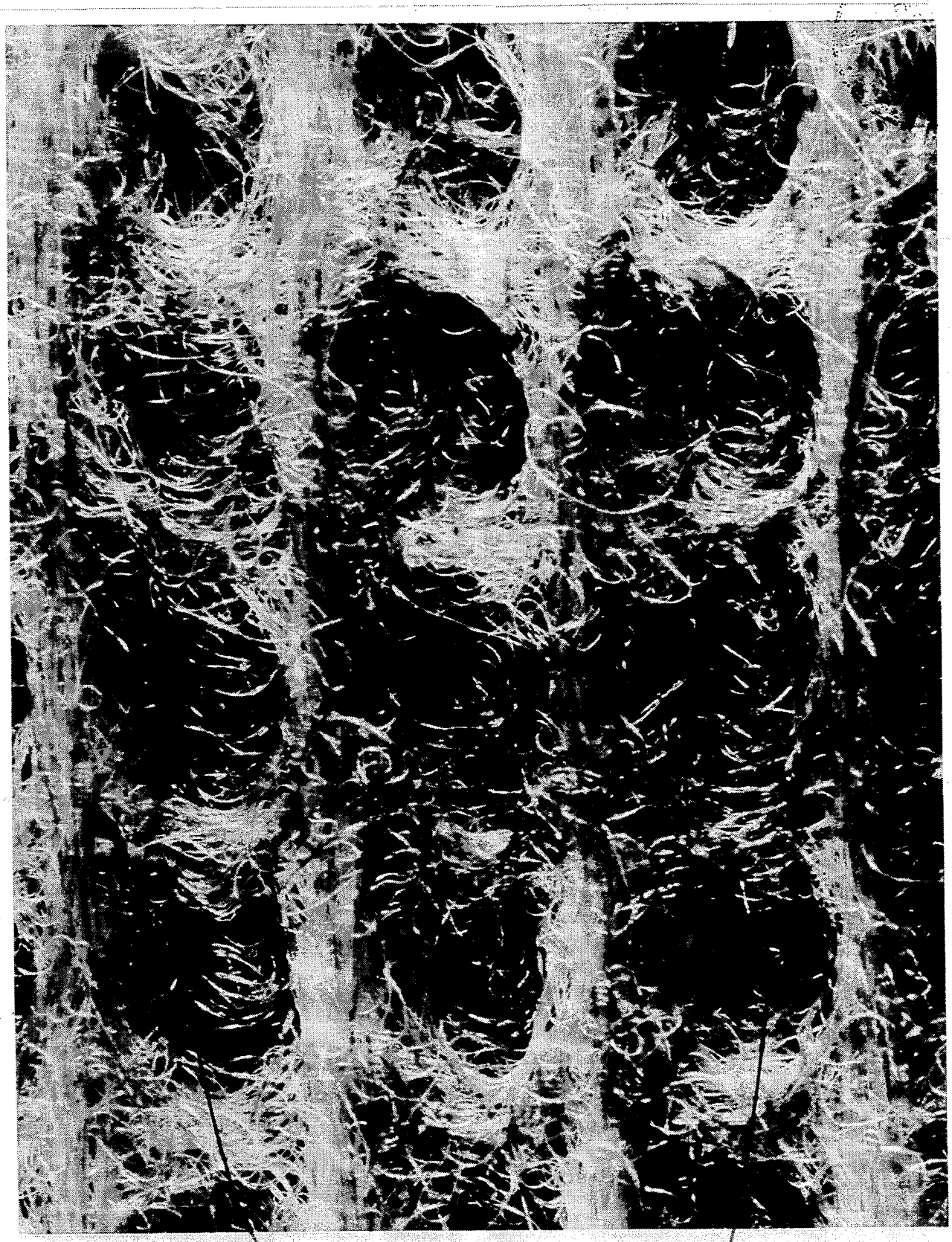
FIG. 10 is a photomicrograph of a nonwoven fabric produced with the apparatus depicted in FIGS. 1, 2 and 3, showing the side of the fabric which faces the perforated hollow drum.
Figure 11:
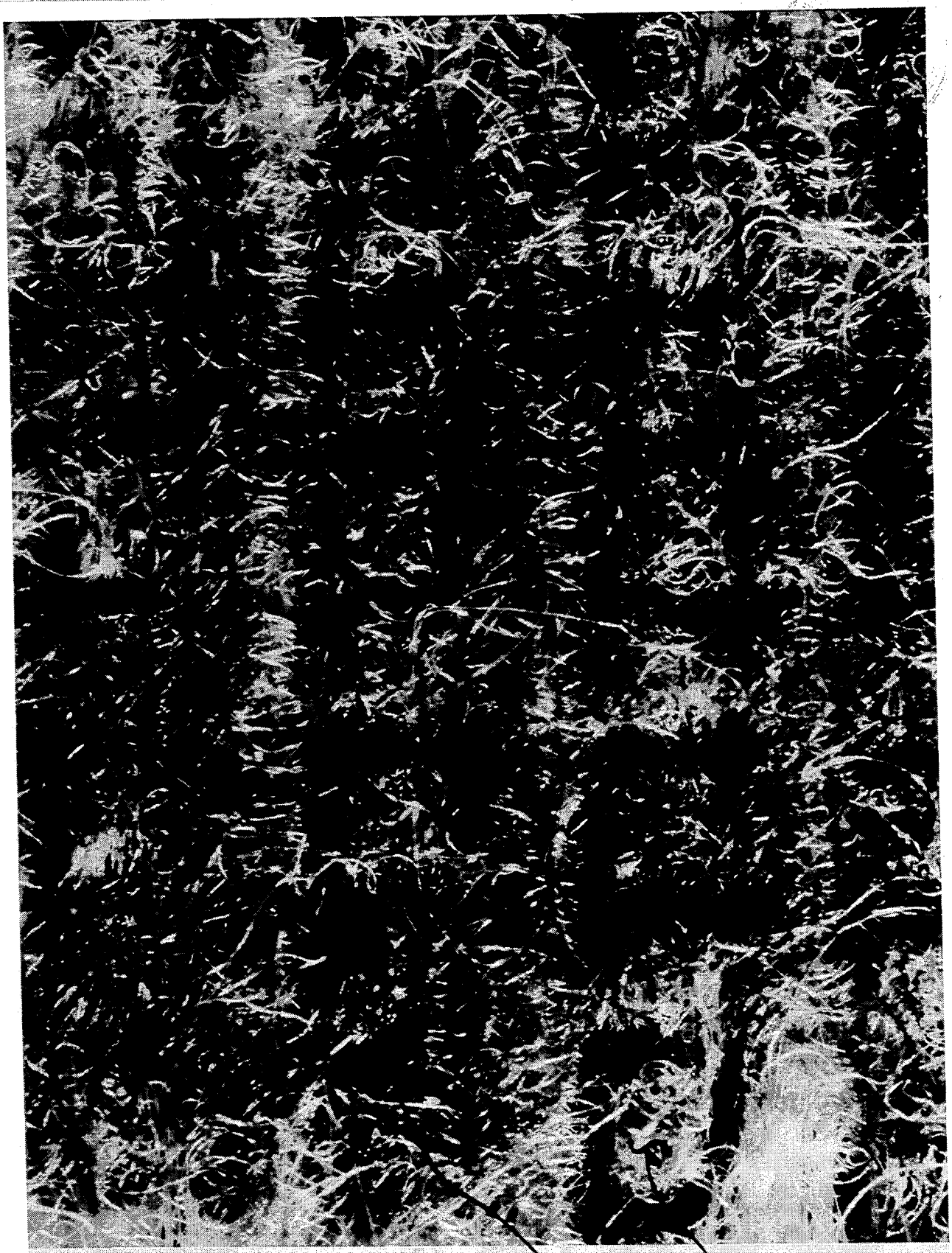
FIG. 11 is a photomicrograph of a nonwoven fabric produced with the apparatus depicted in FIGS. 1, 2 and 3, showing the side of the fabric facing the screen belt.
Figure 12:
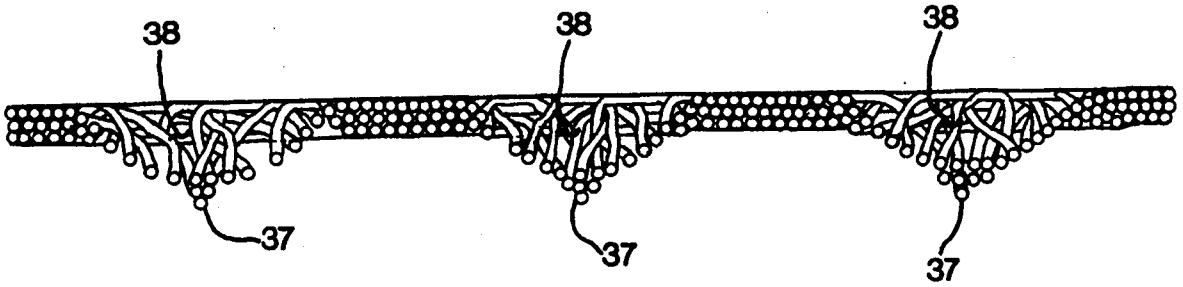
FIG. 12 is a schematical view in cross-section of the fabric shown in FIGS. 10 and 11; and Throughout the drawings, the same reference numerals designate identical or similar components.

The nonwoven fabric network structures obtained under the operating conditions depicted in FIGS. 6 to 8 are novel. FIGS. 10 and 11 are photomicrographs of the respective sides of the preferred fabric structure obtained by the setup of FIG. 8, while FIG. 12 is a schematical illustration depicting the cross-sectional fiber distribution pattern across the fabric. As it is shown in FIG. 10, the fabric has a highly cohesive reticular network, the holes which extend transversely to the plane of the fabric are identified by the reference numeral 38. The holes 38 are closed at one extremity by the protuberant fiber packings or knobs 37, best shown in FIG. 11. The fabric has two textured sides, one including a pattern of recesses formed by the openings of the blind holes 38, the other side having a knobby surface resulting from the apexes of the protuberant fiber packings 37. Accordingly, the fabric has a very distinct feel, one surface being knobby and the other surface containing the openings of the holes 38, being much softer.

The starting material 36 used with the method and apparatus of this invention can be any of the standard fibrous webs such as oriented card webs, isowebs, airlaid webs or webs formed by liquid deposition. The webs may be formed in a single layer or by laminating a plurality of the webs together. The fibers in the web may be arranged in a random manner or may be more or less oriented as in the card web. The individual fibers may be relatively straight or slightly bent. The fibers intersect at various angles to one another such that adjacent fibers come into contact only at the points where they cross. Possible types of fibers are polyester rayon, cotton, bico, polypropylene, nylon, acrylic, and mixtures thereof, among others.

If it is desired to increase the resistance of the fabric according to the invention, a binder substance may be applied in a known fashion. Possible binder substances are acrylic, ethylene vinyl, vinyl chloride, vinyl acetate, polyvinyl alcohol, polyvinyl acetate carboxilated polystyrene, rubber and polyethylene emulsion and mixtures thereof, among others. The binder substance may be incorporated directly in the fiber entangling fluid streams to treat the fabric simultaneously during fiber entangling step. The fluid streams may also be used as a vehicle to apply a fire retardant composition, a coloring die or any other suitable agent to the fabric.

As stated earlier, the novel fabric structure has a distinctive appearance, softness and feel. It has been found that it is particularly well suited for making general purpose wiping cloths. When compared to commerically available wiping cloths, such as the J-cloth* (trademark of Johnson & Johnson), it has superior performance in various categories, as summarized in the following table, yet being made with less binder than the J-cloth, which provides a considerable advantage in terms of manufacturing costs.

| | FABRIC ACCORDING TO THE INVENTION | J-CLOTH |
|---|---|---|
| Binder (% per weight) | 15 | 19 |
| Weight (g/m$^2$) | 53.2 | 52.2 |
| Tensile strength M.D. (Newton) | 367 | 342 |
| Tensile strength C.D. (Newton) | 57 | 47.8 |
| Bulk (4 ply per inch) | 0.083 | 0.060 |
| Absorptive capacity (%) | 1005 | 828 |
| Absorbency rate (seconds) | 1.2 | 1.6 |
| Washability (cycles) | 120 | 100 |

The above description of preferred embodiments should not be interpreted in any limiting manner as these embodiments may be refined without departing from the spirit of the invention. The scope of the invention is defined in the appended claims.

The embodiments of the invention in which an exclusive property or privilege is claimed are defined as follows:

1. An apparatus for producing a unitary nonwoven fabric from a fibrous starting material in sheet form whose individual fibers are capable of movement under the influence of applied fluid forces, said apparatus comprising a fiber rearranging station, including:

a) an apertured member having a predetermined pattern of fluid passages therethrough;

b) a foraminous member spaced apart from said apertured member to define therewith a fluid permeable supporting structure for said fibrous starting material; and c) means to generate opposed and coatting fluid streams producing respective fluid forces which are applied in opposition to said starting material through said fluid permeable supporting structure, causing a dual-sided fiber entangling of said starting material to form the nonwoven fabric.

2. An apparatus as defined in claim 1, comprising means to move said members in unison through said coacting opposed fluid streams for continuously processing starting material in said fiber rearranging station.

3. An apparatus as defined in claim 2, wherein said apertured member is a hollow drum and said foraminous member is a screen belt in at least a partially overlapping relationship with said drum for holding the starting material against said drum.

4. An apparatus as defined in claim 1, wherein said means for producing opposed fluid streams comprises jet means in a face-to-face relationship coupled to a fluid supply means.

5. An apparatus as defined in claim 4, wherein said means for producing opposed fluid streams comprises a pair of manifolds on either side of said fluid permeable supporting structure, a plurality of jets on each manifold, spaced apart from one another thereon, said manifolds being coupled to said fluid supply means.

6. An apparatus as defined in claim 5, wherein said apertured member is a hollow drum and said foraminous member is a screen belt in at least a partially overlapping relationship with said drum for holding the starting material against said drum, one of said manifolds being positioned within said drum with the jets thereof oriented toward an internal wall of said drum, the other of said manifolds being positioned outside of said drum with the jets thereof oriented toward said screen belt.

7. An apparatus as defined in claim 5, wherein some of said jets are spaced in a longitudinal direction and others in a transverse direction on the manifold.

8. An apparatus as defined in claim 1, comprising means upstream of said fiber rearranging station for carding the fibers of the starting material in a machine direction.

9. An apparatus as defined in claim 1, comprising means to apply a binder to effect a bond between fibers of said network.

10. An apparatus am defined in claim 1, wherein said individual fibers are selected from the group consisting of polyester, rayon, cotton, bico, polypropylene, nylon, acrylic and mixtures thereof.

11. An apparatus as defined in claim 9, wherein said binder is selected from the group consisting of vinyl ethylene, vinyl chloride, vinyl acetate, polyvinyl alcohol, acrylic, polyvinyl acetate, carboxylated polystyrene, rubber, polyethylene emulsion and mixtures thereof.

12. An apparatus as defined in claim 1, comprising means for controlling the velocity of each fluid stream to control the structure of said nonwoven fabric.

13. An apparatus as defined in claim 6, further comprising means to control a fluid supply pressure to each manifold to control the velocity of each fluid stream for in turn controlling the structure of said nonwoven fabric.

14. An apparatus as defined in claim 13, comprising means to establish a pressure differential between the fluid supplies to the manifolds.

15. An apparatus as defined in claim 14, comprising means to establish a higher fluid supply pressure to the manifold positioned within said drum.

16. An apparatus as defined in claim 14, comprising means to establish a higher fluid supply pressure to the manifold positioned outside of said drum.

17. An apparatus for producing a unitary nonwoven fabric from a fibrous starting material in sheet form whose individual fibers are capable of movement under the influence of applied fluid forces, said apparatus comprising a fiber rearranging station, including:

two fluid permeable members spaced apart from one another defining a supporting structure for confining said fibrous starting material; and means for advancing said fibrous starting material while in a confined condition through a fluid treatment zone comprising opposed and coacting fluid streams in a staggered relationship producing respective fluid forces applied in opposition to said fibrous starting material through said supporting structure, causing a progressive dual-sided fiber entangling of said fibrous starting material to form the nonwoven fabric.

18. An apparatus for producing a three-dimensional unitary nonwoven fabric from a fibrous starting material in sheet form whose individual fibers are capable of movement under the influence of applied fluid forces, said apparatus comprising a fiber rearranging station, including:

two fluid permeable spaced apart from one another defining a supporting structure for confining said fibrous starting material; and means for advancing said fibrous starting material while in a confined condition through a fluid treatment zone comprising opposed and coacting fluid streams, whereby respective fluid forces applied in opposition to said fibrous starting material through said supporting structure, causing a dual-sided fiber entangling of said fibrous starting material to form a nonwoven fabric having a network defining a pattern of blind holes, each hole extending transversely to the plane of the fabric and containing a protuberant fiber packing at a closed end thereof; and means for controlling the intensity of said fluid forces to control the fiber distribution profile of said network in a transverse direction to the plane of the fabric.

19. An apparatus as defined in claim 18, comprising means to increase the velocity of one fluid stream relatively to the velocity of an opposite fluid stream for increasing the size of the protuberant fiber packings and to decrease the size of the blind holes.

20. An apparatus as defined in claim 18, comprising means to increase the velocity of one fluid stream relatively to the velocity of an opposite fluid stream for increasing the size of the blind holes and to decrease the size of the protuberant fiber packings.

* * * * *

UNITED STATES PATENT AND TRADEMARK OFFICE

CERTIFICATE OF CORRECTION

PATENT NO. : 5,428,876

DATED : July 4, 1995

INVENTOR(S) : Boulanger et al.

It is certified that error appears in the above-identified patent and that said Letters Patent is hereby corrected as shown below:

Column 12, line 40, "coatting" should read -- coacting --.

Column 13, line 19, "am" should read -- as --.

Signed and Sealed this

Tenth Day of October, 1995

*Attest:*

Bruce Lehman

BRUCE LEHMAN

*Attesting Officer*

*Commissioner of Patents and Trademarks*